US006457892B1

(12) United States Patent
Mehrabi et al.

(10) Patent No.: US 6,457,892 B1
(45) Date of Patent: Oct. 1, 2002

(54) WRITING INSTRUMENT HAVING A CAPILLARY HOLE THROUGH THE CONTAINER

(75) Inventors: Reza Mehrabi, Tujunga, CA (US); Dale Harder, Placentia, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/839,842

(22) Filed: Apr. 20, 2001

(51) Int. Cl.[7] ..... B43K 5/00
(52) U.S. Cl. ..... 401/198; 401/199
(58) Field of Search ..... 401/198, 199, 401/196, 205, 223

(56) References Cited

U.S. PATENT DOCUMENTS

| | | | | |
|---|---|---|---|---|
| 535,588 | A | 3/1895 | Horton | |
| 1,166,896 | A | 1/1916 | Garvey | |
| 1,387,754 | A | 8/1921 | Bates | |
| 2,740,979 | A | 4/1956 | Bridy | 15/134 |
| 3,113,336 | A | 12/1963 | Langnickel | |
| 3,397,939 | A | 8/1968 | Berry | 401/198 |
| 3,457,014 | A | 7/1969 | Ward | 401/41 |
| 3,479,122 | A | 11/1969 | Funabashi | |
| 3,501,225 | A | 3/1970 | Martin et al. | |
| 3,873,218 | A | 3/1975 | Yoshida | 401/292 |
| 3,905,709 | A | 9/1975 | Bok | |
| 3,922,100 | A | 11/1975 | Saito | |
| 3,993,409 | A | 11/1976 | Hart | |
| 4,238,162 | A | 12/1980 | Sherwood | 401/198 |
| 4,341,482 | A | 7/1982 | Wollensak | 401/251 |
| 4,382,707 | A | 5/1983 | Anderka | 401/198 |
| 4,496,258 | A | 1/1985 | Tanaka et al. | |
| 4,549,828 | A | 10/1985 | Anderka et al. | 401/258 |
| 4,556,336 | A | 12/1985 | Sano et al. | |
| 4,588,319 | A | 5/1986 | Neimeyer | |
| 4,662,769 | A | 5/1987 | Goh | 401/259 |
| 4,671,692 | A | 6/1987 | Inaba | 401/199 |
| 4,712,937 | A | 12/1987 | Schmidt et al. | |
| 4,764,045 | A | 8/1988 | Tschawow | 401/198 |
| 4,770,558 | A | 9/1988 | Frietsch | |
| 4,923,317 | A | 5/1990 | Bishop et al. | |
| 5,087,144 | A | 2/1992 | Wada et al. | |
| 5,102,251 | A | 4/1992 | Kaufmann | |
| 5,124,200 | A | 6/1992 | Mallonee | 428/296 |
| 5,163,767 | A | 11/1992 | Lucas | |
| 5,172,995 | A | 12/1992 | Felgentreu | 401/258 |

(List continued on next page.)

FOREIGN PATENT DOCUMENTS

| | | |
|---|---|---|
| DE | 1 269 010 | 1/1969 |
| DE | 1 511 395 | 7/1969 |
| DE | 1 461 588 | 8/1971 |

(List continued on next page.)

OTHER PUBLICATIONS

U.S. patent application Ser. No. 09/591,114, filed Jun. 9, 2000, Kaufmann.
German disclosure document entitled "Docht–Schreiber" dated Jul. 10, 1963.
Evaluation dated Aug. 3, 1989 by Institut Textile De France (ITF).

*Primary Examiner*—David J. Walczak
(74) *Attorney, Agent, or Firm*—Squire, Sanders & Dampsey L.L.P.

(57) ABSTRACT

One feature of the present invention is to provide a capillary hole through a storage container that is holding the liquid so that as the underpressure within the container increases, atmospheric air may enter through the capillary hole to hold the underpressure at a predetermined level. One of the advantages with the present invention is that air enters through the container wall and not through the conveying line. That is, the diameter of the capillary hole formed in the container may be more precisely controlled than trying to control the largest pore size in the conveying line. This means that the performance of the writing instrument may be held to a tighter tolerance because the underpressure in the container may be more accurately controlled.

44 Claims, 3 Drawing Sheets

U.S. PATENT DOCUMENTS

| | | | | |
|---|---|---|---|---|
| 5,192,154 | A | 3/1993 | Moeck | |
| 5,211,495 | A | 5/1993 | Jozat et al. | 401/217 |
| 5,290,116 | A | 3/1994 | Chang | |
| 5,352,052 | A | 10/1994 | Kaufmann | |
| 5,362,168 | A | 11/1994 | Abe et al. | |
| 5,407,448 | A | 4/1995 | Brandt et al. | |
| 5,420,615 | A | 5/1995 | Witz et al. | 346/140 |
| 5,427,463 | A | 6/1995 | Bastiansen et al. | 401/134 |
| 5,443,322 | A | 8/1995 | Jozat et al. | 401/195 |
| 5,445,466 | A | 8/1995 | Mukunoki | |
| 5,480,250 | A | 1/1996 | Birden | |
| 5,482,191 | A | 1/1996 | Kaufmann | |
| 5,556,215 | A | 9/1996 | Hori | |
| 5,622,857 | A | 4/1997 | Goffe | 435/378 |
| 5,641,078 | A | 6/1997 | Kaufmann | |
| 5,897,264 | A | 4/1999 | Baudino | 401/199 |
| 5,927,885 | A | 7/1999 | Duez et al. | 401/199 |
| 5,938,362 | A | 8/1999 | Bastiansen | 401/209 |
| 5,965,468 | A | 10/1999 | Marmon et al. | 442/340 |
| 5,971,646 | A | 10/1999 | Chavatte et al. | 401/199 |
| 6,039,486 | A | 3/2000 | Breslin | 401/88 |
| 6,062,758 | A | 5/2000 | Maurer et al. | 401/199 |
| 6,089,776 | A | 7/2000 | Kaufmann | |
| 6,095,707 | A | 8/2000 | Kaufmann | 401/199 |
| 6,183,155 | B1 | 2/2001 | Kaufmann | |

FOREIGN PATENT DOCUMENTS

| | | | |
|---|---|---|---|
| DE | 2 124 298 | | 11/1972 |
| DE | 24 24 918 | | 12/1975 |
| DE | 2754338 | | 12/1977 |
| DE | 28 44 886 | | 8/1979 |
| DE | 28 08 910 | | 9/1979 |
| DE | 2434378 | | 3/1986 |
| DE | 3433393 | | 3/1986 |
| DE | 3434188 | | 3/1986 |
| DE | 3502592 | | 7/1986 |
| DE | 3504462 | | 8/1986 |
| DE | 3642037 | | 6/1988 |
| DE | 3903606 | A1 | 2/1989 |
| DE | 38 15 882 | | 12/1989 |
| DE | 3824941 | | 1/1990 |
| DE | 4115685 | A1 | 5/1991 |
| DE | 44 03 771 | | 8/1995 |
| DE | 19706967 | | 2/1997 |
| DE | 19610644 | A1 | 9/1997 |
| DE | 19832046.9 | | 7/1998 |
| DE | 298 23 054 | | 6/1999 |
| DE | 299 10 459 | | 10/2000 |
| DE | 199 30 540 | | 1/2001 |
| EP | 85115513.5 | | 12/1985 |
| EP | 86109151.0 | | 7/1986 |
| EP | 87105388.0 | | 4/1987 |
| EP | 90111302.7 | | 6/1990 |
| EP | 90306121.6 | | 6/1990 |
| EP | 91106645.4 | | 4/1991 |
| EP | 91115307.0 | | 9/1991 |
| EP | 92401454.1 | | 5/1992 |
| EP | 0 899 128 | A1 | 8/1998 |
| EP | 00110952.9 | | 5/2000 |
| FR | 87610 | | 1/1965 |
| FR | 422 575 | | 4/1965 |
| FR | 79 19412 | | 7/1979 |
| FR | 83 04258 | | 3/1983 |
| FR | 2737862 | | 8/1996 |
| GB | 941439 | | 11/1964 |
| GB | 2205280 | A | 5/1988 |
| GB | 2241882 | A | 2/1991 |
| JP | 48-36844 | | 2/1973 |
| JP | 59-12229 | | 4/1984 |
| JP | 2-48377 | | 4/1990 |
| NL | 7701595 | | 8/1978 |
| NL | 7907389 | | 4/1981 |
| WO | PCT/US91/04622 | | 6/1991 |
| WO | PCT/DE92/00361 | | 4/1992 |
| WO | 93/00989 | | 11/1992 |
| WO | 93/01796 | | 7/1993 |
| WO | PCT/DE96/01530 | | 8/1996 |
| WO | PCT/EP96/04223 | | 9/1996 |
| WO | 98/00663 | | 2/1997 |
| WO | 98/03856 | | 6/1997 |
| WO | PCT/CH99/00433 | | 9/1999 |
| WO | US00/17575 | | 1/2001 |

FIG. 1
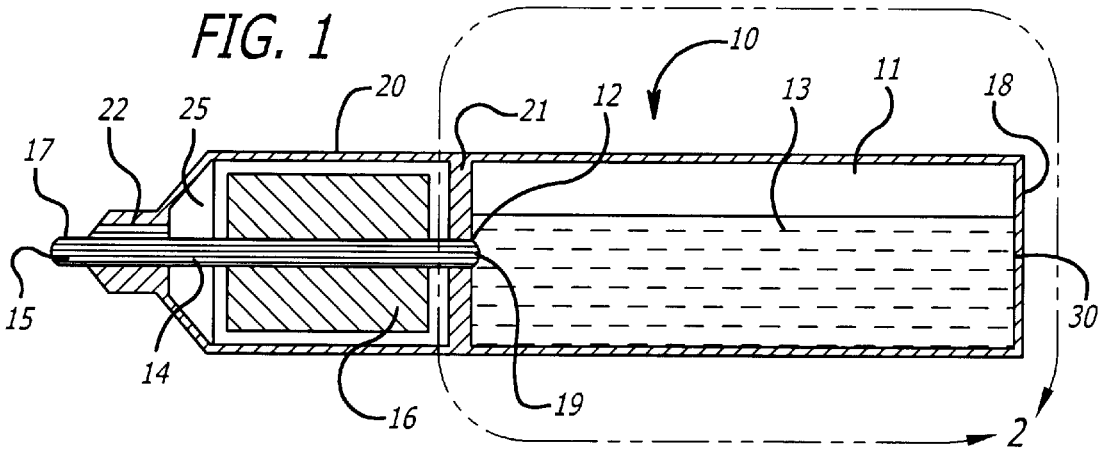
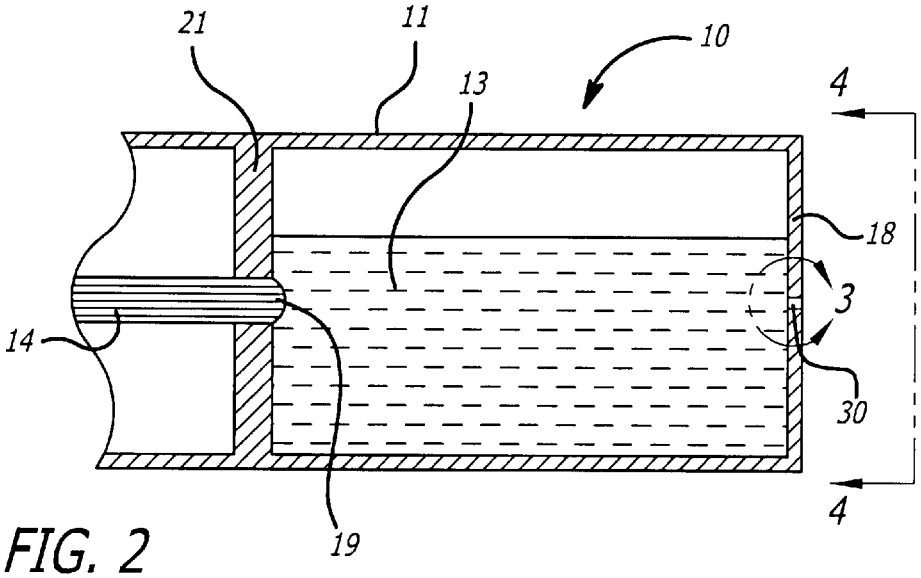
FIG. 2
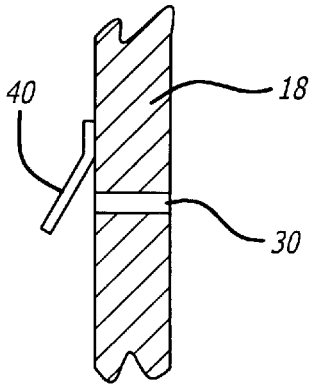
FIG. 3
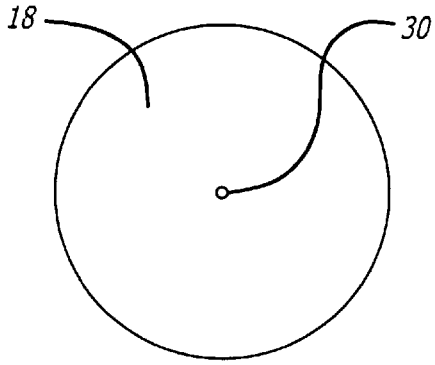
FIG. 4

WRITING INSTRUMENT HAVING A CAPILLARY HOLE THROUGH THE CONTAINER

BACKGROUND OF THE INVENTION

1. Field of the Invention

The present invention relates generally to a writing instrument and, more particularly, to a writing instrument which regulates flow air into a storage container that holds liquid to prevent leakage.

2. General Background and State of the Art

Writing instruments are commonly used to deliver liquids such as ink, paint, adhesives, shoe polish, lotion, medicine, perfume, makeup, white out and food. In one type of liquid dispensing utensil, a relatively large volume of liquid is stored in a non-capillary container (or reservoir) where it is allowed to move freely. Pens which incorporate such a container, for example, are generally referred to as "free ink" pens. U.S. Pat. No. 6,095,707 issued to Kaufmann discloses such a pen. That is, the ink in the reservoir is usually in a liquid state, and is free to move about as the writing utensil is moved. Liquid in these utensils is transferred from the container to the delivery end (often referred to as a tip or a nib) via a capillary conveying line (also referred to as a wick). A slight vacuum (underpressure) relative to the atmosphere is maintained within the container which prevents liquid in the conveying line from escaping from the utensil until the tip is brought into contact with the surface onto which liquid is to be dispensed. At this point, the force of attraction of the surface and the capillary force of the space between the surface and portions of the tip which are not in direct contact with the surface will cause the liquid to flow from the tip to the surface. As liquid is dispensed, air enters the container through the largest pore size in the conveying line. The air replaces the liquid so as to maintain the underpressure within the container at a relatively constant level.

To deal with the problem of leakage caused by air expansion within the container, a capillary storage is used to absorb the excess liquid. Specifically, when the air within the container is heated it expands. This causes the underpressure within the container to subside and increases the vapor pressure on the liquid. This forces excess liquid to flow through the conveying line via capillarity action. To handle the excess liquid, some ink pens include an overflow chamber having a capillary storage that will absorb ink. Fountain pens, for example, include a capillary storage in the front section and sometimes under the nib. This storage has a capillarity that is strong enough to prevent leakage when the pen is held in the writing position, but not so strong that it will be filled during a normal writing operation.

Thus, to optimize the performance of the writing instrument, the pore sizes of the conveying line and storage capillaries need to be carefully controlled. In particular, the largest pore size in the conveying line needs to be carefully controlled. If the largest pore size in the conveying line is too large, then the underpressure within the container may not be held at a relatively constant level because too much air may be flowing into the container. With the underpressure subsiding in the container, excess ink would flow through the conveying line and overwhelm the storage capillary, and ultimately would leak through the nib. On the other hand, if the largest pore size in the conveying line is too small, the underpressure within the container would increase because not enough air is entering the container. This would restrict the flow of ink through the conveying line, thereby drying out the nib. Controlling the largest pore size in the conveying line, however, may be difficult. That is, with current manufacturing methods, the largest pore size in one conveying line may vary from one conveying line to another conveying line, such that one writing instrument may provide excess ink while another writing instrument may not provide enough ink.

Therefore, there is still a need for a writing instrument that can more accurately control air inlet to the container such that the underpressure within the container can be more accurately controlled.

Another problem with the writing instrument is that only one end is used to write. That is, when a conveying line has a relatively large diameter, the writing may be relatively thick. So when a user wants to write in a fine line, the user must change the writing instrument in order to do so. Therefore, there is a need for a writing instrument that can provide for both a wide and a fine writing capability.

BRIEF SUMMARY OF THE INVENTION

One feature of the present invention is to provide a capillary hole through a storage container that is holding the liquid so that as the underpressure within the container increases, atmospheric air may enter through the capillary hole to hold the underpressure at a predetermined level. One of the advantages with the present invention is that air enters through the container wall and not through the conveying line. That is, the diameter of the capillary hole formed in the container may be more precisely controlled than trying to control the largest pore size in the conveying line. This means that the performance of the writing instrument may be held to a tighter tolerance because the underpressure in the container may be more accurately controlled.

Alternatively, a second nib may be provided through the capillary hole on the opposite side of the first nib. In this embodiment, the second nib may be used to control the air inlet through the container and, at the same time, be used for writing purposes thereby providing a writing instrument that can produce writing in both a thick and a fine line.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

A detailed description of the embodiments in accordance with the present invention will be made with reference to the accompanying drawings.

FIG. 1 is an exemplary cross-sectional view of a writing instrument in accordance with one embodiment of the present invention;

FIG. 2 is an exemplary enlarged cross-sectional view of a storage container around the encircled area 2 in FIG. 1;

FIG. 3 is an exemplary enlarged cross-sectional view of the encircled area 3 in FIG. 2;

FIG. 4 is an exemplary rear view as indicated by the directional arrows 4—4 in FIG. 2;

DETAILED DESCRIPTION OF THE PREFERRED EMBODIMENTS

Figure 5:
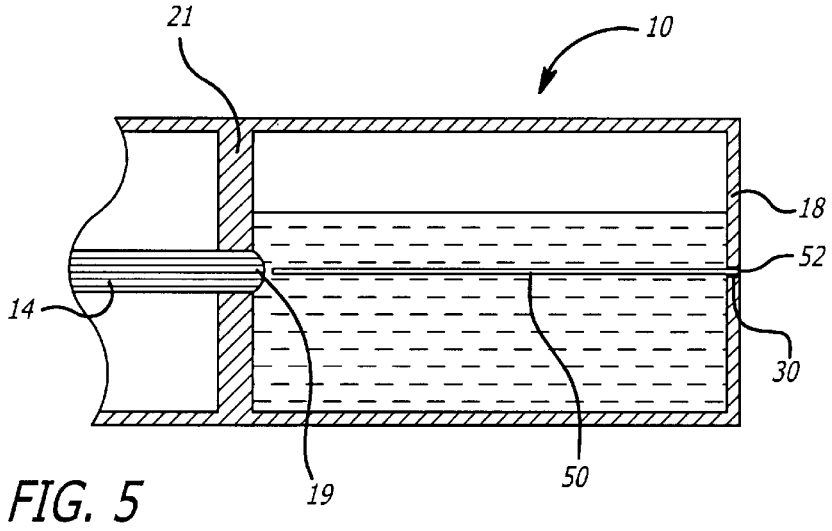
FIG. 5 is an exemplary cross-sectional view of a storage container in accordance with another embodiment of the present invention.

The following is a detailed description of a number of embodiments of the invention. This description is not to be taken in a limiting sense, but is made merely for the purpose of illustrating the general principles of the invention.

By way of background, it should be noted that the descriptive term "capillarity" has been used herein to indicate the height up to which a liquid ascends within a pore of a given diameter. The greater the height, the greater the capillarity. In general, small size pores have greater capillarity than the larger size pores. In other words, the term "capillarity" is indicative of the attractive force between a liquid and a pore. Moreover, U.S. Pat. Nos. 6,089,776, 6,183,155 B1, and U.S. patent application Ser. No. 09/591,114 filed Jun. 9, 2000, entitled "Efficient Fluid Dispensing Utensil" are all hereby incorporated by reference into this patent application.

As shown by way of example in FIG. 1, one embodiment of the present invention (generally represented by reference numeral 10) includes a housing 20 comprising of a container 11 for storing liquid 13 and an overflow chamber 25. Container 11 and overflow chamber 25 may be separated by a partition or wall 21. It is to be understood, however, that partition 21 is only an exemplary representation of the boundary between the container and overflow chamber. Container 11 may also be embodied in any suitable manner, either as an integral part of housing 20 or as a separate element connected to the housing. A tip 15 extends from one end of housing 20 in a known manner.

Partition 21 includes an opening 12 which, as shown by way of example in FIG. 1, is closed by a capillary conveying line 14, having a proximal end 17 and a distal end 19. The distal end 19 of the conveying line 14 is in contact with the liquid 13 and the proximal end 17 is in contact with the tip 15. Alternatively, the proximal end may be formed to form the tip 15. Moreover, at least a portion of the conveying line is in direct contact with a capillary storage 16. The average capillarity of capillary storage 16 is smaller than the average capillarity of conveying line 14. Put differently, the capillary storage 16 may be measured to have an approximate mean storage flow pore size that is greater than the measurable approximate mean conveying flow pore size of the conveying line 14. Moreover, the capillary storage may have an approximate smallest pore size, and the capillary wick may have an approximate largest pore size, where the approximate smallest pore size of the capillary storage is smaller than the approximate largest pore size of the capillary wick. The pore sizes in the capillary storage 16 and conveying line 14 may be measured by Porous Material, Inc., 83 Brown Road, Ithaca, N.Y. 14850. Although the capillary storage is arranged about the periphery of capillary conveying line 16 in the embodiment shown in FIG. 1, there is no requirement that it extend all the way around the conveying line. Also, the strict separation of capillary storage 16 and conveying line 14 shown in FIG. 1 is not absolutely necessary.

The ink in the reservoir or container 11 is held in place by an "underpressure" (slight vacuum) of the air above the ink, which counteracts the force of gravity pulling on the ink inside the utensil (the head pressure). This underpressure controls the ink flow out of the marker, like a straw full of liquid with a finger over the top which creates a slight vacuum within the straw to hold the liquid therein. The underpressure depends on many factors, such as, the liquid's viscosity, specific gravity and surface tension, the diameter of the tube, the size of the opening at the bottom of the tube, the surface energy of the tube, atmospheric pressure and even temperature all affect how well the liquid wants to stay where it is. The relationship of the above factors as it relates to flow of liquid is listed in the table below.

| Property | | High | Low |
|---|---|---|---|
| Liquid: | Viscosity | resists flow | flows freely |
| | Specific gravity | flows freely | resists flow |
| | Surface tension | resists flow | flows freely |
| Tube: | Diameter | flows freely | resists flow |
| | Bottom opening | flows freely | resists flow |
| | Surface energy | resists flow | flows freely |
| Atmosphere: | Pressure | resists flow | flows freely |
| | Temperature | flows freely | resists flow |
| | Gravity | flows (constant force while on earth) | |

As illustrated by way of example in FIG. 2, one-way of controlling the underpressure in the container 11 is by controlling the diameter of the capillary hole 30 on the bottom 18, which controls the airflow into the container 11. For example, during writing, the finer capillaries of the conveying line 14 transfers liquid 13 to the tip. As liquid 13 leaves the reservoir, however, underpressure will increase (this is a double negative, so the absolute pressure within the reservoir will decrease). But at the same time, the underpressure will want to remain constant. Thus, to compensate, air is drawn into the container 11 (reservoir) through the capillary hole 30. The present invention is unlike some prior art where it has been observed that, under normal writing conditions, air generally enters through a single largest pore in the conveying line.

Although, in extreme conditions where the change in underpressure is rapid, air may also enter through the next largest pore in the conveying line 14. As such, each individual marker will have its own individual underpressure, due to the variability of the largest pore size from one conveying line to another.

In contrast, with the present invention, the diameter of the capillary hole 30 may be more precisely controlled in comparison to the largest pore size in the conveying line 14. This way, the underpressure within the container 11 may be more accurately controlled so that the performance of the writing instruments may be held to a tighter tolerance. In particular, if the diameter of the capillary hole is too large, air will easily flow into the container and the underpressure will drop, causing excess ink to flow out of the container. Consequently, most of the liquid will flow into the capillary storage, or even out of the writing instrument if the capillary storage is full. On the other hand, if the diameter of the capillary hole 30 is too small, airflow into the container will be restricted causing the underpressure within the container to rise. This will restrict the liquid within the container from leaving through the conveying line 14, which will result in drying of the tip 15. Thus, the diameter of the capillary hole 30 needs to be carefully sized to have consistent performance of the writing instrument.

Properly sizing the diameter of the capillary hole 30 depends on a number of factors as discussed above, such as the type of liquid, configuration of the container, and atmosphere. In general, however, for solvent based ink which has surface tension of about 22 to about 28 dynes, may have a diameter of the capillary hole 30 may be about 45 microns to 20 microns. For water-based ink which has higher surface tension than the solvent based ink, the diameter of the capillary hole 30 may be about 50 microns to about 30 microns. In particular, the diameter of the capillary hole 30 needs to be at least greater than the largest measurable pore size in the conveying line 14 so that the diameter of the capillary hole 30 is used to regulate the air flow into container 11 rather than the largest pore size in conveying line 14.

FIG. 3 illustrates by way of example an optional flap valve 40 coupled to the inner side of the bottom wall 18. The flap valve prevents evaporation of the water from liquid 13 in container 11 and liquid 13 from flowing through the capillary hole 30 as the underpressure within the container 11 subsides, i.e., as the absolute pressure rises in the container. That is, the flap valve 40 prevents the water from evaporating through the capillary hole 30 so that the composition of the liquid 13 within the container 11 remains substantially constant over a period of time. Moreover, as the underpressure within the container 11 subsides, liquid within the container will take path of least resistance to convey out of the container 11, which in this case is the largest pore size or the capillary hole 30. To prevent leakage of liquid through the capillary hole 30, the flap valve 40 closes off the capillary hole 30 as the underpressure subsides in the container 11. This way, liquid 13 conveys through the conveying line 14 and into capillary storage 16 rather than leaking through the capillary hole 30.

On the other hand, as the underpressure within the container rises, the flap valve allows outside air to enter through the capillary hole to relieve the underpressure. In other words, the flap valve 40 is designed to be a one-way valve so that outside air may enter through the capillary hole 30, but substantially prevents vapors and liquid from container 11 from leaving through the capillary hole 30. It is within the scope of the present invention to use any other one-way valve that is known to one skilled in the art.

FIG. 4 illustrates by example the location of the capillary hole 30 in an area that is substantially in the center of the bottom 18. The location of the capillary hole 30, however, may be located anywhere along the container 11 that provides a direct path to liquid 13.

FIG. 5 illustrates by way of example an alternative embodiment to the present invention. Here, a tube 50, having an opening 52 therethrough may be inserted through the capillary hole 30. In this embodiment, rather than controlling the diameter of the capillary hole 30 to regulate the flow of air into container 11, the diameter of the opening 52 in tube 50 is used to regulate the flow of air into container 11. The diameter of opening 52 in tube 50 depends upon a number of factors as discussed above to regulate the flow of air into the container 11. An exemplary tube 50 having a well controlled opening 52 may be manufactured by Teibow Hanbai Company, Limited, which is located at 10-15 Higashi, Nihonbashi 3 Ohome, Chou-ku, Tokyo 103, Japan. The length of the tube 50 may vary from being flush against the bottom 18 and being long enough to be adjacent to the distal end 19 of the conveying line 14, as illustrated in FIG. 5. Having the tube extending out toward the distal end 19 or the partition 21 allows the tube 50 to remain wetted by the ink 13. Having the tube 50 wetted substantially prevents liquid vapors within the container 11 from escaping through the tube 50. Moreover, keeping the opening 52 wetted prevents the liquid within the opening from drying out and plugging the opening 52.

Figure 6:
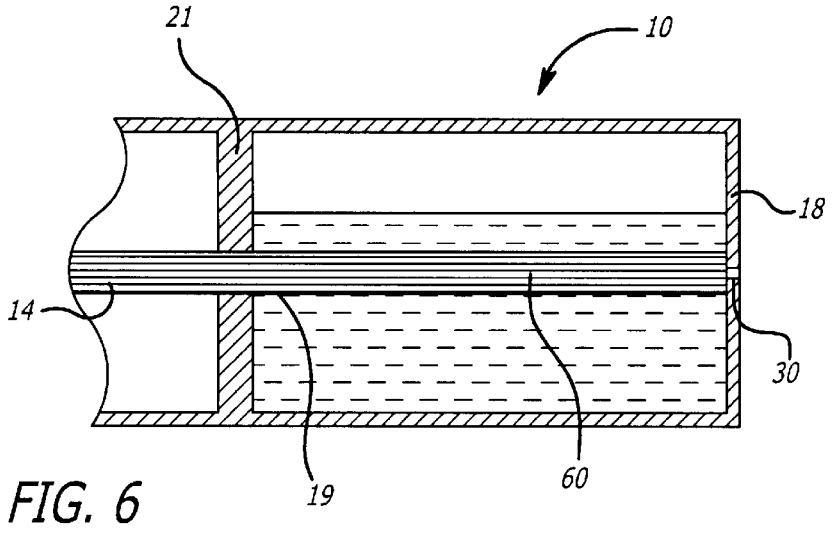
FIG. 6 is an exemplary cross-sectional view of a storage container in accordance with yet another embodiment of the present invention.

FIG. 6 illustrates by way of example a feeder rod 60 in between the distal end 19 of the conveying line 14 and the capillary hole 30. In this embodiment, the feeder rod 60 is designed to keep the capillary hole 30 wetted so that the vapors in the container 11 do not evaporate through the capillary hole 30. Moreover, the feeder rod 60 keeps the capillary hole 30 wetted so that it does not dry out to keep the capillary hole 30 open.

Figure 7:
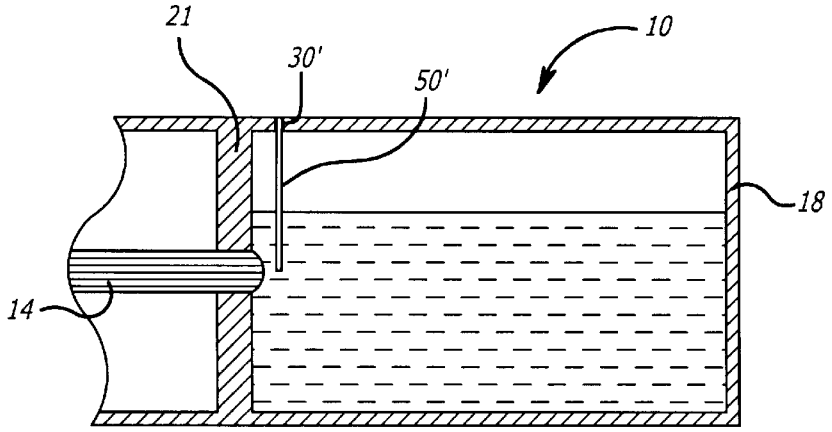
FIG. 7 is an exemplary cross-sectional view of a storage container in accordance with still another embodiment of the present invention.

FIG. 7 illustrates by way of example yet another alternative embodiment in which the capillary hole 30' is located adjacent to the partition 21. Moreover, to keep the capillary hole 30' wet, a tube 50' may extend from the capillary hole 30' to the center of the container 11.

Figure 8:
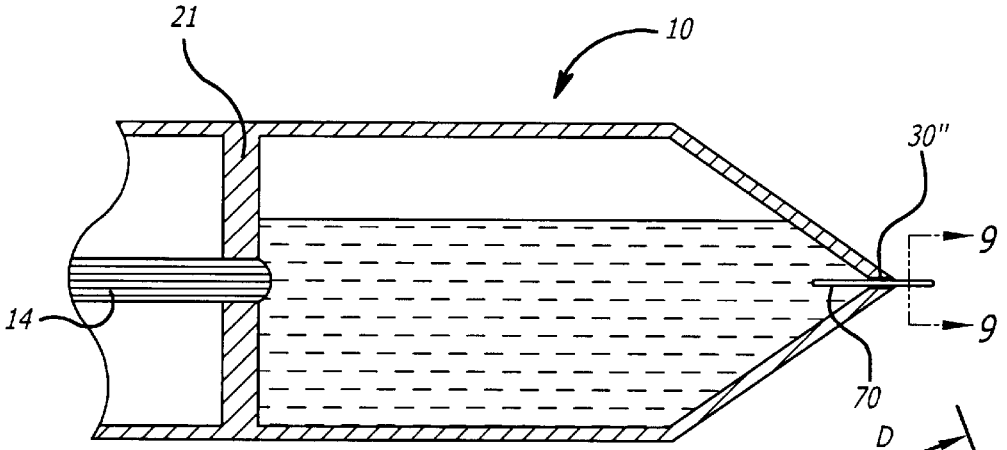
FIG. 8 is an exemplary cross-sectional view of an alternative embodiment of the present invention.

FIG. 8 illustrates by way of example yet another alternative embodiment of the present invention in which a nib 70 protrudes from the capillary hole 30". In this embodiment, the nib 70 is similar to the tube 50 illustrated in FIG. 5, except that the nib 70 protrudes out so that it may be used for writing. To prevent leakage, if any, in this embodiment, a one-way valve on a cap may be used over the nib 70 on the distal end of the maker. This way, the nib would remain wetted and prevent excessive evaporation of the liquid through the nib 70. Thus, the nib 70 can act as an air regulator without drying out.

Figure 9:
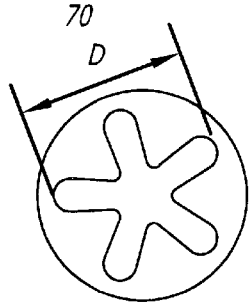
FIG. 9 is an exemplary cross-sectional view along line 9—9 in FIG. 8.

FIG. 9 illustrates by way of example the cross-sectional view of the nib along the line 9—9 in FIG. 8. Nib 70 in this example generally performs two functions. That is, nib 70 may be used for writing fine lines relative to tip 15. On the other hand, if tip 15 is used for writing, nib 70, has a predetermined diameter to control the flow of air into container 11, so that the underpressure in container 11 may be maintained. Again, nib 70 may be manufactured by Teibow Hanbai Company, Ltd.

Moreover, if the nib 70 is used for writing, the largest pore in the conveying line may be used to transfer air into the container, and the capillary storage 16 also works to absorb any excess ink as the underpressure within the container 11 subsides. That is, the diameter D of the nib 70 may be sized so that the nib 70 may be used for writing without leaking through the nib 70 as underpressure within the container subsides. To do so, the diameter D of the capillary pore in the nib 70 is sized to be smaller than the largest pore size in the conveying line 14. This means that the path of least resistance is through the largest pore in the conveying line 14 rather than the capillary pore in the nib 70. As such, as the underpressure in the container 11 subsides, i.e., absolute pressure rises in the container, liquid conveys through the path of least resistance which in this case is the largest pore size in the conveying line 14 so liquid does not leak through the nib 70. Rather, liquid conveys through the conveying line 14 and into the capillary storage 16. Still further, the smallest pore size in the capillary storage may be smaller than the pore size or diameter D of the nib 70 so that liquid conveys to the capillary storage 16 to absorb excess liquid.

Figure 10:
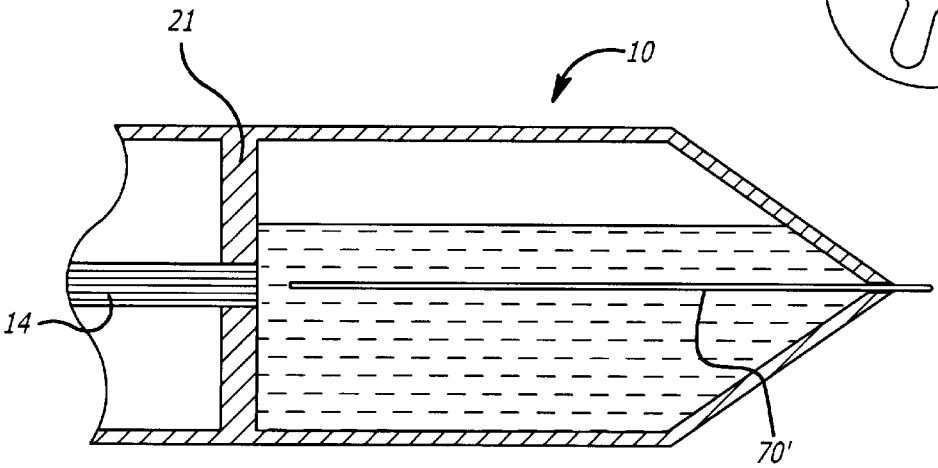
FIG. 10 is an exemplary cross-sectional view of an alternative embodiment of the embodiment illustrated in FIG. 8.
Figure 11:
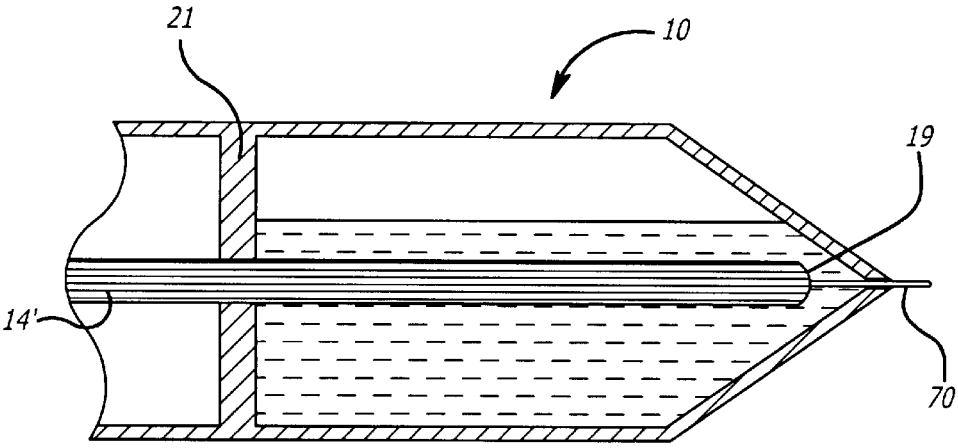
FIG. 11 is an exemplary cross-sectional view of yet another embodiment of the embodiment shown in FIG. 8.

FIG. 10 illustrates by way of example the nib 70' extending near the partition 21. This prevents the vapors within container 11 from escaping through nib 70' and keeps nib 70' wet so that it does not dry out. Still further, FIG. 11 illustrates by way of example the distal end 19 of conveying line 14' extending to nib 70 so that nib 70 remains wetted.

In closing, it is noted that specific illustrative embodiments of the invention have been disclosed hereinabove. However, it is to be understood that the invention is not limited to these specific embodiments. With respect to the claims, it is applicant's intention that the claims not be interpreted in accordance with the sixth paragraph of 35 U.S.C. §112 unless the term "means" is used followed by a functional statement.

What is claimed is:

1. A writing instrument, comprising:

a container defining a first storage area for storing liquid and a second storage area;

a tip;

a capillary wick having a proximal end and a distal end, the proximal end coupled to the tip and the distal end in contact with the liquid in the first storage area; at least a portion of the capillary wick in the second storage area, and the capillary wick defining an approximate mean wick flow pore size and an approximate largest wick pore size;

a capillary storage within the second storage area and at least a portion of the second storage is in direct contact with the capillary wick, and the capillary storage defining an approximate mean storage pore size; and a capillary hole formed in the container to allow air to flow between the first storage area and atmosphere, the capillary hole having a predetermined diameter that is greater than the approximate largest wick pore size, and the approximate mean wick flow pore size of the capillary wick being smaller than the approximate mean storage pore size of the capillary storage.

2. A writing instrument according to claim 1, including a wall between the first and second storage areas, wherein the wall has an opening that is completely filled by the capillary wick.

3. A writing instrument according to claim 2, wherein the capillary hole is formed adjacent to the wall.

4. A writing instrument according to claim 1, wherein the capillary storage is separated from the first storage area such that the capillary storage only comes into contact with the liquid from the first storage through the capillary wick.

5. A writing instrument according to claim 1, wherein the capillary hole allows air to enter the first storage area to compensate for the liquid taken from the first storage area of the container through the capillary wick.

6. A writing instrument according to claim 1, wherein the capillary hole is aligned with the capillary wick along its longitudinal axis and on an opposite side of the tip on the container.

7. A writing instrument according to claim 6, further including a tube having an opening therethrough within the first storage area, wherein the opening of the tube is aligned with the capillary hole.

8. A writing instrument according to claim 7, wherein the tube extends from the capillary hole to near the capillary wick.

9. A writing instrument according to claim 6, further including a feeder rod between the capillary wick and the capillary hole.

10. A writing instrument according to claim 1, wherein the liquid is a solvent base ink.

11. A writing instrument according to claim 10, wherein the capillary hole has a predetermined diameter of about 45 microns to about 20 microns.

12. A writing instrument according to claim 1, wherein the liquid is a water base ink.

13. A writing instrument according to claim 12, wherein the capillary hole has a diameter of about 50 microns to about 30 microns.

14. A writing instrument according to claim 1, further including a valve associated with the capillary hole to regulate evaporation of the liquid within the first storage.

15. A writing instrument according to claim 14, wherein the valve is a flap valve.

16. A writing instrument according to claim 1, wherein the capillary hole has a predetermined diameter that is restricted so that a predetermined underpressure within the first storage area is substantially maintained as the liquid within the first storage area is transferred out of the first storage area through capillarity action of the capillary wick.

17. A writing instrument according to claim 1, wherein the capillary storage has an approximate smallest pore size, and the capillary wick has an approximate largest pore size, wherein the approximate smallest pore size of the capillary storage is smaller than the approximate largest pore size of the capillary wick.

18. A writing instrument according to claim 1, further including a nib within the capillary hole.

19. A writing instrument according to claim 18, wherein the nib has a predetermined capillary pore size to convey the liquid from the first storage for writing on a surface.

20. A writing instrument according to claim 19, wherein the liquid is a solvent base ink, wherein the predetermined capillary pore size of the nib is about 45 microns to about 20 microns.

21. A writing instrument according to claim 19, wherein the liquid is a water base ink, wherein the predetermined capillary pores size of the nib is about 50 microns to about 30 microns.

22. A writing instrument according to claim 18, wherein the nib extends near to the distal end of the capillary wick.

23. A writing instrument according to claim 18, wherein the distal end of the capillary wick extends to the nib.

24. A method of compensating for liquid leaving a storage container of a writing instrument, comprising:

holding liquid in a storage container having a predetermined underpressure within the storage container to prevent the liquid from unintentionally flowing out of the storage container;

providing an opening in the storage container;

filling the opening with a capillary wick to transfer liquid from the storage container to a tip;

storing excess liquid from the storage area in a capillary storage in direct contact with the capillary wick;

controlling the flow of air into the liquid storage container through a capillary hole formed on the storage container to substantially maintain the predetermined underpressure within the storage container so that a predetermined amount of liquid flows out of the storage container due to capillarity action as the tip is moved over a writing surface; and separating the storage container from the capillary storage so the liquid from the storage container only comes into contact with the liquid from the storage container through the capillary wick.

25. A method according to claim 24, further including:

aligning the capillary hole to the capillary wick along its longitudinal axis and forming the capillary hole on an opposite side of the tip on the storage container.

26. A method according to claim 24, wherein a tube having an opening therethrough is within the storage container, wherein the opening of the tube is aligned with the capillary hole.

27. A method according to claim 26, wherein the tube extends from the capillary hole and adjacent to the capillary wick.

28. A method according to claim 24, further including a feeder rod between the capillary wick and the capillary hole.

29. A method according to claim 24, wherein the capillary hole is formed adjacent to the opening in the storage container.

30. A method according to claim 24, wherein the liquid is a solvent base ink, and the capillary hole having a predetermined diameter of about 45 microns to about 20 microns.

31. A method according to claim 24, wherein the liquid is a water base ink, and the capillary hole having a diameter of about 50 microns to about 30 microns.

32. A method according to claim 24, further including:

regulating the evaporation of the liquid from the storage container through the capillary hole.

33. A method according to claim 24, wherein the capillary storage has an approximate smallest pore size, and the capillary wick has an approximate largest pore size, wherein the approximate smallest pore size of the capillary storage is smaller than the approximate largest pore size of the capillary wick.

34. A method according to claim 24, further including:

inserting a nib through the capillary hole.

35. A method according to claim 34, further including:

conveying the liquid from the storage container through the nib to write on a writing surface.

36. A method according to claim 34, wherein the nib extends near to the opening of the storage container.

37. A method according to claim 34, further including:

extending the capillary wick to the nib.

38. A method of compensating for liquid leaving a storage container of a writing instrument, comprising:

holding liquid in a storage container having a predetermined underpressure within the storage container to prevent the liquid from unintentionally flowing out of the storage container;

providing an opening in the storage container;

filling the opening with a capillary wick to transfer liquid from the storage container to a tip;

storing excess liquid from the storage area in a capillary storage in direct contact with the capillary wick; and controlling the flow of air into the liquid storage container through a capillary hole formed on the storage container to substantially maintain the predetermined underpressure within the storage container so that a predetermined amount of liquid flows out of the storage container due to capillarity action as the tip is moved over a writing surface, wherein the capillary storage has an approximate smallest pore size, and the capillary wick has an approximate largest pore size, wherein the approximate smallest pore size of the capillary storage is smaller than the approximate largest pore size of the capillary wick.

39. A writing instrument, comprising:

a container defining a first storage area for storing liquid and a second storage area;

a capillary wick having a proximal end and a distal end, the proximal end coupled to a tip and the distal end in contact with the liquid in the first storage area;

at least a portion of the capillary wick in the second storage area, and the capillary wick defining an approximate mean wick flow pore size and an approximate largest wick pore size;

a capillary storage within the second storage area and at least a portion of the second storage in direct contact with the capillary wick, and the capillary storage defining an approximate mean storage pore size; and a hole formed in the container to allow air to flow into the first storage area from atmosphere so that underpressure within the first storage is substantially maintained as the liquid flows out of the first storage through the capillary wick, where the approximate mean wick flow pore size of the capillary wick is smaller than the approximate mean storage pore size of the capillary storage.

40. The writing instrument according to claim 39, wherein the hole has a predetermined size that is greater than the approximate largest wick pore size.

41. A writing instrument, comprising:

a container defining a first storage area for storing liquid and a second storage area;

a capillary wick having a proximal end and a distal end, the proximal end coupled to a tip and the distal end in contact with the liquid in the first storage area;

at least a portion of the capillary wick in the second storage area, and the capillary wick defining an approximate mean wick flow pore size;

a capillary storage within the second storage area and at least a portion of the second storage in direct contact with the capillary wick, and the capillary storage defining an approximate mean storage pore size that is larger than the approximate mean wick flow pore size; and means for substantially maintaining underpressure within the first storage as the liquid flows out of the first storage through the capillary wick.

42. A writing instrument, comprising:

a container having a first storage area for storing liquid;

a tip;

a capillary wick having a proximal end and a distal end, the proximal end coupled to the tip and the distal end in contact with the liquid in the first storage area, where the capillary wick has an approximate largest wick pore size; and a capillary hole formed in the container to allow air to flow between the first storage area and atmosphere, the capillary hole having a predetermined diameter that is greater than the approximate largest wick pore size to substantially maintain an underpressure within the first storage as the liquid flow out of the first storage area through the capillary wick.

43. A method for compensating liquid leaving a storage container of a writing instrument, comprising:

holding liquid in a storage container having a predetermined underpressure within the storage container to prevent the liquid from unintentionally flowing out of the storage container;

providing an opening in the storage container;

filling the opening with a capillary wick to transfer the liquid from the storage container to a tip, where the capillary wick has an approximate largest wick pore size;

controlling the flow of air into the liquid storage container through a hole that is formed on the storage container, where the hole's size is greater than the approximate largest wick pore size to substantially maintain the predetermined underpressure within the storage container as the liquid convey out of the storage container through the capillary wick.

44. The method according to claim 41, further including:

storing excess liquid from the storage container conveying through the capillary wick.

* * * * *